United States Patent [19]

Luyckx

[11] 4,342,590

[45] Aug. 3, 1982

[54] EXOTHERMIC STEEL LADLE DESULFURIZER AND METHOD FOR ITS USE

[76] Inventor: Leon A. Luyckx, 226 E. Hazelcroft Ave., New Castle, Pa. 16105

[21] Appl. No.: 188,968

[22] Filed: Sep. 19, 1980

[51] Int. Cl.[3] ..... C21C 7/02

[52] U.S. Cl. ..... 75/58; 75/57

[58] Field of Search ..... 75/27, 53, 58

[56] References Cited

U.S. PATENT DOCUMENTS 3,025,153 3/1962 Cross ..... 75/27

*Primary Examiner*—P. D. Rosenberg

*Attorney, Agent, or Firm*—Thomas H. Murray

[57] ABSTRACT

An exothermic, reducing and basic ladle desulfurizing mix, and method for its use, which minimizes the temperature drop encounterd by the molten steel tapped from the furnace. The mix is comprised essentially of finely-divided particulate iron and/or manganese oxide, aluminum with minor magnesium and/or calcium alloying additions, and burnt lime. The need for other fluxing agents such as fluorspar is minimized or eliminated.

8 Claims, No Drawings

EXOTHERMIC STEEL LADLE DESULFURIZER AND METHOD FOR ITS USE

BACKGROUND OF THE INVENTION

Four essential conditions govern good desulfurization of molten iron or steel by a slag phase. These are: (1) high basicity or V ratio, (2) high temperature, (3) low oxygen potential, and (4) high slag-metal emulsion rate. The foregoing essential conditions were first recognized and applied with success by Rene Perrin of Ugine Aciers, France around 1937. Perrin prefused an artificial slag in a separate furnace, the slag composition being about 50% CaO and 50% $Al_2O_3$. After thoroughly deoxidizing slag and steel in an electric arc furnace prior to tapping, Perrin poured the hot, liquid and prefused artificial slag onto the bottom of the ladle and immediately tapped the steel from the furnace into it. This tapping operation routinely brought the sulfur content from 0.025% down to 0.005% or less in the ladle sample, an 80% drop. This is equivalent to the results obtained today with lengthy post-tapping injection procedures.

While the method proposed by Perrin was exceedingly effective to lower sulfur contents in steel, it will be readily appreciated that predeoxidation of the steel and the slag in the furnace and separate prefusion of artificial slags are procedures too expensive and time-consuming for commercial applications.

In U.S. Pat. No. 4,142,887 a ladle desulfurization composition and method are disclosed in which molten steel to be desulfurized is exposed to a mixture of particulate metallic aluminum, fluorspar and lime to deoxidize and desulfurize the metal and form a fluxed slag. The desulfurizing composition described in the aforesaid patent accomplishes effective desulfurization of molten steel without predeoxidation and separate prefusion of the slag; but the composition extracts intrinsic heat from the molten steel and rapidly cools the molten steel. Accordingly, higher temperatures are required in the molten steel to supply the intrinsic heat required and satisfy the second essential condition described above.

SUMMARY OF THE INVENTION

The present invention, while following the same high temperature thermal chemical conditions first discovered by Perrin, adapts the process to the needs and contraints of modern, massive production of carbon steels at much lower cost. In this regard, prefusion of the desulfurizing mix as proposed by Perrin is replaced by a rapid Thermit reaction on impact with the steel from the furnace and predeoxidation in the furnace is replaced by excess aluminum metal premixed with the slag. Extraction of heat as in the process of U.S. Pat. No. 4,142,887 is, therefore, minimized.

In addition to the importance of low oxygen potential previously established, experience has recently shown that the temperature factor has been underestimated, particularly with the emergence of the fast-growing electric furnace process. The present invention provides a direct response to the temperature loss problem associated with modern slag-desulfurization efforts while not sacrificing the previously-acquired knowledge of the beneficial effects of metallic aluminum in desulfurizing mixes, and of the ideal combination of CaO and $Al_2O_3$ as a low-melting point, highly basic slag for desulfurization. Specifically, the desulfurization composition of the invention consists essentially of a mixture of particulate alkaline earth oxides, particulate metal oxides selected from the group consisting of iron oxide and manganese oxide, finely-divided metal including at least 75 weight percent aluminum and the balance selected from the class consisting of aluminum, calcium and magnesium.

In order to keep the artificial slag of a reducing nature as a whole, particularly for low carbon steels, the addition of $FeO$-$Fe_2O_3$ and/or MnO to the mix must be carefully balanced with the corresponding Al+Mg and/or Ca, plus an excess of this metallic deoxidizer, to take care of the FeO, MnO and $SiO_2$ content of the slag carried over from the furnace and of the oxygen content of the tapping steel.

Because of the additional $Al_2O_3$ and increased temperature generated by these reactions, the traditional fluorspar flux proposed in U.S. Pat. No. 4,142,887 can be drastically reduced or eliminated, thereby further reducing sensible heat absorption without basicity contribution, smoke generation, and, most of all, ladle lining wear. The additional hot alumina is the main high temperature flux for lime without much effect on the lining.

DESCRIPTION OF THE PREFERRED EMBODIMENTS

In view of the fact that iron and manganese oxides directly counteract the desulfurization process, their presence in the artificial slag has to be short-lived immediately after the liquid metal contacts the slag if desulfurization is to be effective. Consequently, fine division of both the oxide and the deoxidizer is of paramount importance for an early reaction and instant heat generation to reproduce the Perrin conditions. On the other hand, the dilution of these highly reactive ingredients with sufficient quantities of lime to insure safe handling is the practical upper limit to Thermit concentration.

High-quality burnt lime is of critical importance to the success of the mix, although not specifically to this invention. Up to 10% magnesium oxide is acceptable with at least 90% calcium oxide. The choice of the oxidizing agent for the Thermit reaction is governed by economical as well as metallurgical considerations.

From an economic standpoint, the $FeO$-$Fe_2O_3$ system without MnO is preferred. Such iron oxides can be derived from BOF flue dust, for example, or from other baghouse residue rich in $Fe_2O_3$, barring excessive contamination with tramp elements such as zinc or lead, or contamination with excessive silica. Silica, however, can be accepted up to 5% by weight of the oxide. From a metallurgical standpoint, manganese oxide fines can present two major advantages. First, manganese and manganese oxide can actively participate in the desulfurization reaction, manganese oxide being more basic than iron oxide. Secondly, the oxidation of aluminum by manganese oxide is less exothermic and thus less violent than by FeO or $Fe_2O_3$. Also, with virtually 100% pickup of the manganese units into the steel bath, a credit can be applied to the cost of the desulfurizer by saving on the ferromanganese addition. In the practical implementation of the invention, local conditions will dictate the choice of the oxide ingredient. Mill scale, unless thoroughly dehydrogenized, cannot be utilized.

The reducing agent has to be at least 65% metallic aluminum, either atomized, ground or otherwise reduced to powder with up to 25% of magnesium plus calcium from recycling or added on purpose to increase the speed of the early reaction. Here, economic considerations will dictate local metal purchases even more than the oxides. The sizing of the deoxidizer is more important than its purity. At least 50% should be −50 mesh, and 90% −10 mesh. Ideally, over 75% should be between 100 and 325 mesh. However, too much ultrafine should be avoided for safety reasons, particularly in the unpassivated form.

The preferred composition of the present invention includes:

Finely-divided alkaline earth oxide, at least 90% by weight calcium oxide—50%-85% by weight of the composition;

Finely-divided metal oxide, principally iron oxide, although some manganese oxide may be included—5%-25% by weight;

Powdered metal, principally aluminum, although some magnesium and/or calcium may be included—10%-30% by weight; and Flux—principally fluorspar—up to 10% by weight.

The following Table I sets forth typical compositions of the present ladle desulfurizing composition which have particular utility, depending upon the steel undergoing desulfurization and the demands of final sulfur specifications.

TABLE I

LADLE DESULFURIZING COMPOSITIONS

| Ingredient | Weight Percent | | | | | |
|---|---|---|---|---|---|---|
| Composition | A | B | C | D | E | F |
| Lime* | 75 | 75 | 70 | 65 | 60 | 60 |
| Metal oxide** (iron or iron and manganese) | 5 | 5 | 10 | 12.5 | 15 | 17.5 |
| Metal (aluminum or aluminum plus magnesium and/or calcium) | 10 | 15 | 20 | 22.5 | 25 | 22.5 |
| Fluorspar | 10 | 5 | 0 | 0 | 0 | 0 |
| TOTAL | 100 | 100 | 100 | 100 | 100 | 100 |

*At least 90% CaO, may contain MgO.

**May contain silica contaminants not to exceed 5% by weight.

Composition A is a low-cost composition which achieves desulfurization with minimum materials cost.

Composition B is a low-cost composition for use with low-carbon molten steels.

Composition C is a particularly hot mixture which develops maximum exothermicity.

Composition D is a medium-cost composition particularly adapted for use with low-carbon steels.

Compositions E and F are high efficiency compositions having a higher materials cost than A, B, C and D and a significantly higher desulfurization potential. E is particularly suited to low-carbon steels. Composition F is particularly suited to medium-carbon steels.

The desulfurization is carried out by contacting each ton of molten steel with 5 to 20 pounds of the described desulfurization compositon. This can be done by gravity, injection or any other mechanical means.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. A ladle desulfurization composition for desulfurizing molten steel consisting essentially of a mixture of a particulate alkaline earth oxide; a particulate metal oxide selected from the class consisting of iron oxide and manganese oxide; and a finely-divided metal selected from the class consisting of aluminum, calcium and magnesium; said mixture forming a Thermit composition which will remove sulfur when in contact with molten steel containing sulfur.

2. The method of ladle desulfurizing steel by exothermally generating a reducing and basic artificial slag which will remove sulfur when in contact with molten steel containing sulfur, which method comprises mixing molten steel with a composition consisting essentially of a mixture of a particulate alkaline earth oxide, a particulate metal oxide selected from the group consisting of iron oxide and manganese oxide, and a finely-divided metal selected from the class consisting of aluminum, calcium and magnesium.

3. The method of claim 2 wherein said finely-divided metal includes at least 65 weight percent aluminum and the balance selected from the class consisting of aluminum, calcium and magnesium.

4. The method of claim 2 wherein said alkaline earth oxide is 50-85% by weight of the mixture; the said metal oxide is 5-25% by weight of the mixture; and the said finely-divided metal is 10-30% by weight of the mixture.

5. The method of claim 2 wherein said composition has a size distribution which permits at least 50% by weight to pass through a 50-mesh screen and at least 90% by weight to pass through a 10-mesh screen.

6. The method of claim 2 wherein said composition has a size distribution which permits at least 75% by weight to pass through a 100-mesh screen and to be retained on a 325-mesh screen.

7. The method composition of claim 2 wherein the said alkaline earth oxide is at least 90% by weight calcium oxide.

8. The method composition of claim 7 wherein the alkaline earth oxide is a mixture of calcium oxide and magnesium oxide.

* * * * *